US008516752B2

(12) United States Patent
Macchietto

(10) Patent No.: US 8,516,752 B2
(45) Date of Patent: Aug. 27, 2013

(54) SUPPORT POLE HAVING A TRACK

(75) Inventor: Carl J. Macchietto, Omaha, NE (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 13/805,141

(22) PCT Filed: Jun. 15, 2011

(86) PCT No.: PCT/US2011/040421

§ 371 (c)(1),
(2), (4) Date: Jan. 3, 2013

(87) PCT Pub. No.: WO2011/159747

PCT Pub. Date: Dec. 22, 2011

(65) Prior Publication Data

US 2013/0111848 A1 May 9, 2013

(51) Int. Cl.
*E04H 12/18* (2006.01)

(52) U.S. Cl.
USPC ..... 52/123.1; 52/843

(58) Field of Classification Search
USPC ..... 52/843, 831, 651.02, 651.07, 126.3, 52/123.1, 114; 362/403; 248/320
See application file for complete search history.

(56) References Cited

U.S. PATENT DOCUMENTS

| | | | | |
|---|---|---|---|---|
| 456,859 | A * | 7/1891 | Shank | 248/320 |
| 476,889 | A * | 6/1892 | Meyer | 174/45 R |
| 589,881 | A * | 9/1897 | Warner et al. | 248/320 |
| 3,670,159 | A * | 6/1972 | Millerbernd | 200/2 |
| 3,911,267 | A * | 10/1975 | Kiehn | 362/282 |
| 4,051,525 | A * | 9/1977 | Kelly | 348/143 |
| 5,662,451 | A * | 9/1997 | Muzzi et al. | 414/540 |
| 6,614,125 | B2 * | 9/2003 | Willis et al. | 290/55 |
| 7,004,043 | B2 * | 2/2006 | Erel et al. | 74/89.23 |
| 7,540,637 | B1 * | 6/2009 | Williams | 362/403 |
| 2008/0066431 | A1 * | 3/2008 | Cousins et al. | 53/465 |

FOREIGN PATENT DOCUMENTS

| | | |
|---|---|---|
| JP | 2003-317531 | 11/2003 |
| JP | 2006-196442 | 7/2006 |
| WO | 2005093161 | 10/2005 |
| WO | 2008046145 | 4/2008 |

* cited by examiner

*Primary Examiner* — Christine T Cajilig
(74) *Attorney, Agent, or Firm* — Advent, LLP

(57) ABSTRACT

A support pole having a support member track portion and a support arm track portion is described that is configured to allow lateral and vertical displacement of the carrier device. In one or more implementations, the support pole includes a support member and a support arm extending outwardly from the support member. The support pole includes a support member track portion connected to the support member and a support arm track portion connected to the support arm. The support pole may also include a transition track portion disposed between the support member portion and the support arm portion. The track portions, collectively, are configured to allow a carrier device to transition between a first position and a second position.

18 Claims, 5 Drawing Sheets

SUPPORT POLE HAVING A TRACK

BACKGROUND

Support poles, such as utility poles, are typically positioned adjacent to pathways, such as roadways, walkways, trails, and so forth. These support poles typically include one or more devices that provide services to the adjacent area, such as a light (e.g., a luminaire, or the like) to illuminate the adjacent pathway or a security camera to provide surveillance of the pathway. These devices typically require regular upkeep and maintenance that require workers to utilize a boom truck or a crane, which may inconvenience other users of the pathway.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A support pole having a support member track portion and a support arm track portion is described. In one or more implementations, the support pole includes a support member and a support arm extending outwardly from the support member. The support pole includes a support member track portion connected to the support member and a support arm track portion connected to the support arm. The support pole may also include a transition track portion disposed between the support member portion and the support arm portion. The track portions, collectively, are configured to allow a carrier device to transition between a first position and a second position. The carrier device may initially be in a first position (e.g., adjacent to a base of the support member) and may transition to a second position. It is contemplated that the second position may be any position between the first position and an outer end of the support arm. Hence, the support pole is configured to laterally and to vertically displace a payload connected to the carrier device.

BRIEF DESCRIPTION OF THE DRAWINGS

The detailed description is described with reference to the accompanying figures. The use of the same reference numbers in different instances in the description and the figures may indicate similar or identical items.

DETAILED DESCRIPTION

Overview

Many types of support poles have been previously provided that are positioned adjacent to a roadway, walkway, trail, or the like. In many cases, a payload, such as a security camera or a luminaire, is secured to the upper end of the support pole. In most cases, if the payload requires repair or replacement, it is necessary for a worker to utilize a boom truck or crane to reach the payload to repair or replace the same. In those cases where the payload is positioned on the end of a support arm extending outwardly from the support pole over a roadway or the like, traffic lanes may be closed to enable a boom truck or a crane to reach the payload positioned over the roadway.

Accordingly, a support pole having a support member track portion and a support arm track portion is described. In one or more implementations, the support pole includes a support member and a support arm extending outwardly from the support member. The support pole includes a support member track portion connected to the support member and a support arm track portion connected to the support arm. The support pole may also include a transition track portion disposed between the support member portion and the support arm portion. The track portions, collectively, are configured to allow a carrier device to transition between a first position and a second position. The carrier device may initially be in a first position (e.g., adjacent to a base of the support member) and may transition to a second position. It is contemplated that the second position may be any position between the first position and an outer end of the support arm. Hence, the support pole is configured to laterally and to vertically displace a payload mounted to the carrier device.

In one or more implementations, when the support pole is positioned (e.g., anchored) adjacent to a roadway or a walkway, the support arm is configured to provide a line-of-sight to the roadway or the walkway. For example, the support arm may extend at least partially over the roadway (or walkway) to provide illumination to the roadway from the payload (in the case of the luminaire) or to provide surveillance capabilities from the payload (in the case of security camera).

Example Implementations

Figure 1:
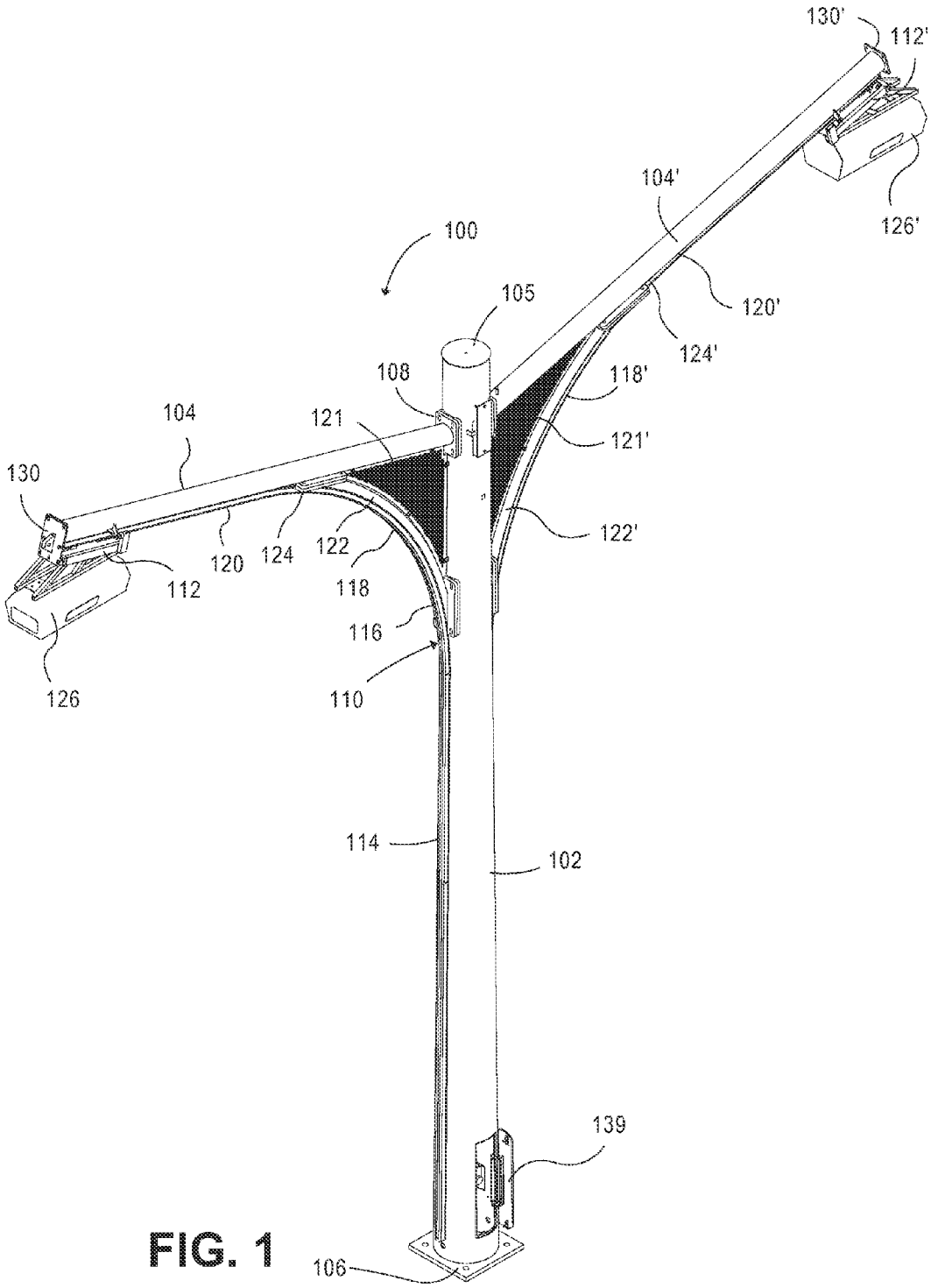
FIG. 1 is a diagrammatic perspective view illustrating a support pole in accordance with an example implementation of the present disclosure.

FIGS. 1 through 5 illustrate support poles 100 in accordance with example implementations of the present disclosure. It is contemplated that the support poles 100 of the present disclosure may encompass a utility pole, such as a free-standing utility pole configured to support one or more payloads positioned proximate to the poles 100. As shown, the support poles 100 include a support member 102 and a support arm 104 connected to the support member 102 proximate to an upper end 105 of the support member 102. As shown in FIG. 1, a lower end 106 (e.g., a plate configured to be anchored to the ground or a lower portion of the pole 100) of the support member 102 is anchored to the ground so that the support member 102 may extend outwardly from the ground in an at least substantially vertical configuration. In one or more implementations, the support member 102 may be anchored to the ground adjacent to a pathway, such as a roadway, a walkway, or the like. The support member 102 may be configured in a variety of ways. For example, the support member 102 may be tapered or may be cylindrical. It is contemplated that the support member 102 may also be at least substantially hollow.

Figure 2:
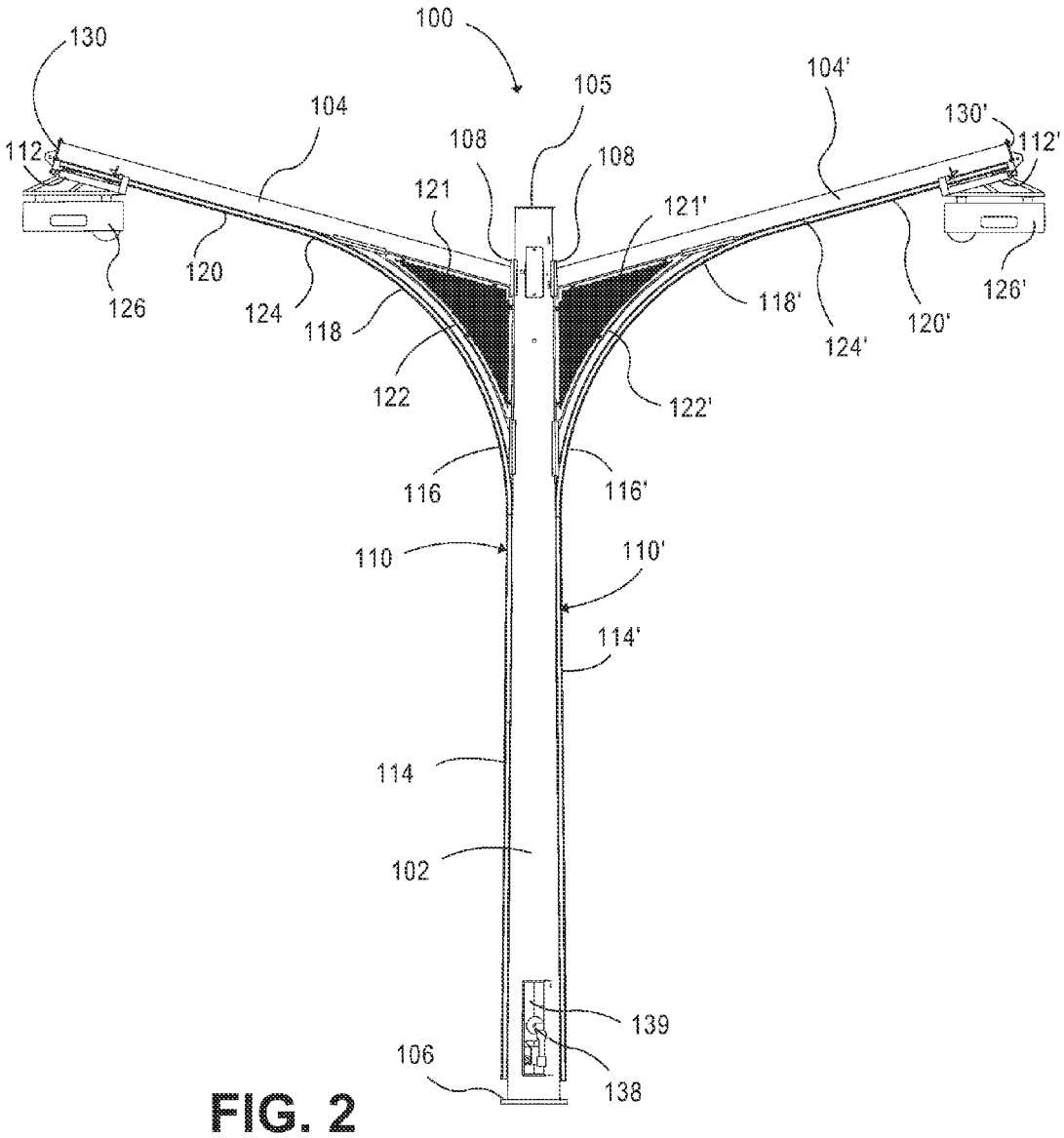
FIG. 2 is another diagrammatic perspective view illustrating the support pole shown in FIG. 1 from another angle.
Figure 3:
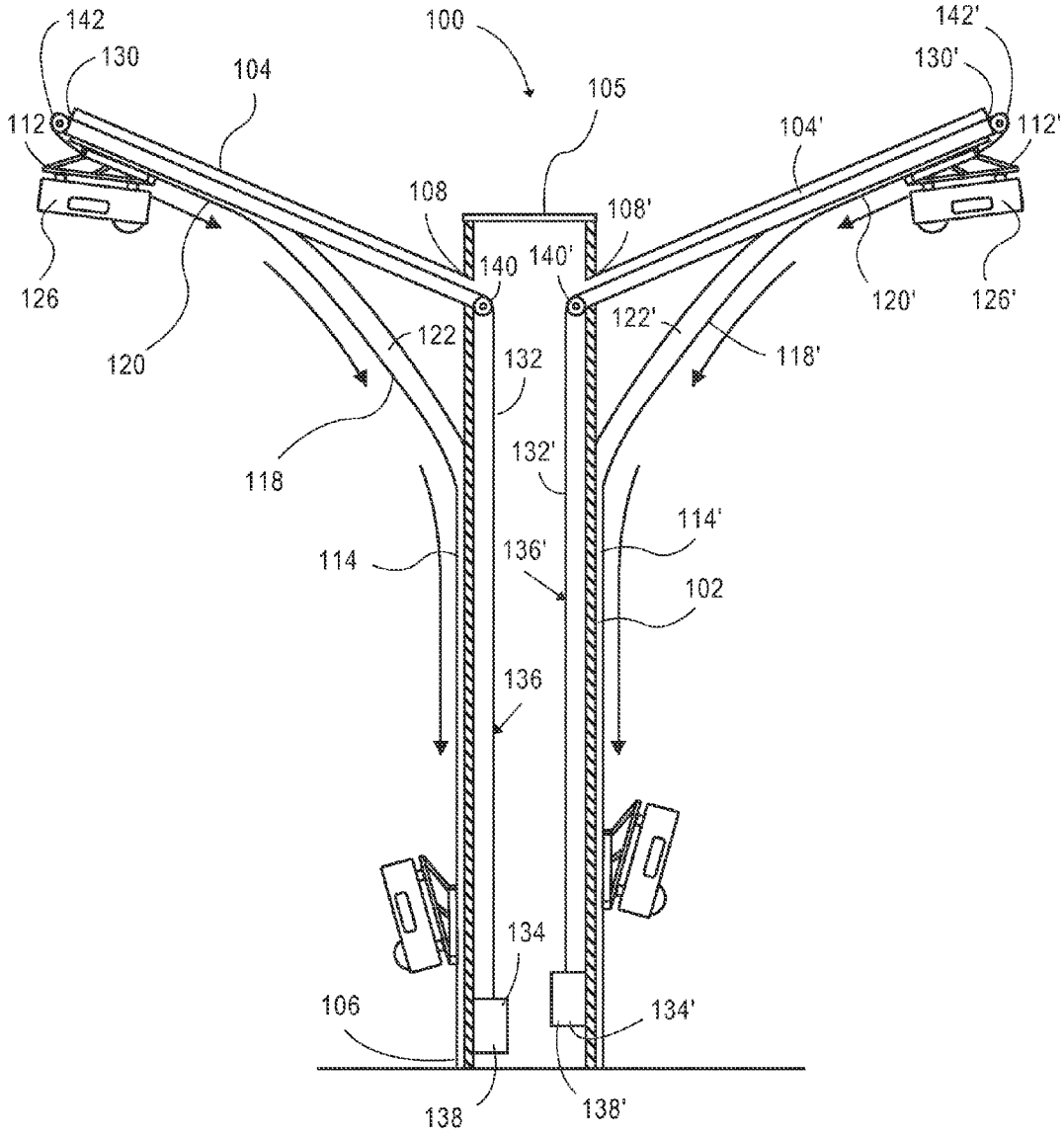
FIG. 3 is diagrammatic cross-sectional view illustrating an implementation of a displacement device included in a support pole, such as the support pole shown in FIGS. 1 and 2.

As shown in FIGS. 1 through 3, the support arm 104 comprises an elongated support member that extends outwardly from the support member 102 in a cantilevered fashion. In one or more implementations, the support arm 104 is configured as a hollow elongated support member. An inner end 108 of the support arm 104 is connected to the support member 102 via one or more suitable processes (e.g., screws, nuts and bolts, welding, etc.). In one or more implementations, the support arm 104 may extend at least partially upwardly and outwardly from the support member 102 as illustrated in FIGS. 1 through 3. The support pole 100 may also include a second support arm 104' that also extends outwardly from the support member 102 in a cantilevered fashion. However, it is contemplated that the support pole may include only a single support arm 104. Inasmuch as the support arms 104, 104' are at least substantially identical, only the support arm 104, and associated components, is described with detail with "'" indicating a substantially identical structure associated with the support arm 104'.

The support pole 100 includes a track assembly 110 that is configured to allow a carrier device 112 (e.g., a trolley, a cart, etc.) to transition between a first position and a second position. It is contemplated that the carrier device 112 may be configured in a variety of ways. For example, as shown in FIGS. 1 and 2, the carrier device 112 may be a self-driving (e.g., self-powered) carrier device. In one or more implementations, a self-driving carrier device may include a motor (e.g., electric motor, gas-powered motor, etc.), or the like. In another example, the carrier device 112 may utilize a pulley assembly (shown in FIG. 3 and described herein) to assist in traversing the track assembly 110.

As illustrated in FIGS. 1 through 3, the track assembly 110 comprises a support member track portion 114 connected (e.g., secured via fasteners, welding, or the like) to the support member 102. In one or more implementations, the support member track portion 114 extends at least substantially along the support member 102 from about the lower end 106 of the support member 102 to a first end 116 of a transition track portion 118. The support member track portion 114 is configured to provide vertical displacement capabilities to the carrier device 112.

The transition track portion 118 serves to function as a transition between the support member track portion 114 and a support arm track portion 120. As illustrated, the transition track portion 118 is connected to a transition portion 122 of the support pole 100. The transition portion 122 is connected (e.g., welded, fastened, etc.) to the support member 102 and the support arm 104. The transition portion 122 may be configured in a variety of ways. For example, the transition portion 122 is, in part, configured as a curved brace portion that extends upwardly and outwardly to provide support to the support arm 104. Thus, the transition track portion 118 may be at least substantially curved (e.g., arcuate) from the first end 116 to the second end 124 to allow the transition track portion 118 to extend along the transition portion 122. As illustrated in FIGS. 1 and 2, a generally triangular-shaped panel 121 may further be secured to the transition portion 122. In one or more implementations, the generally triangular-shaped panel 121 may provide ornamental designs to provide atheistically pleasing features.

The support arm track portion 120 is connected to the support arm 104 and is configured to provide horizontal displacement capabilities to the carrier device 112. The second end 124 of the transition track portion 118 is connected to support arm track portion 120 so that the carrier device may traverse from the support member track portion 114 to the transition track portion 118 and finally to the support arm track portion 120, or vice versa, when the carrier device is engaged.

Figure 4:
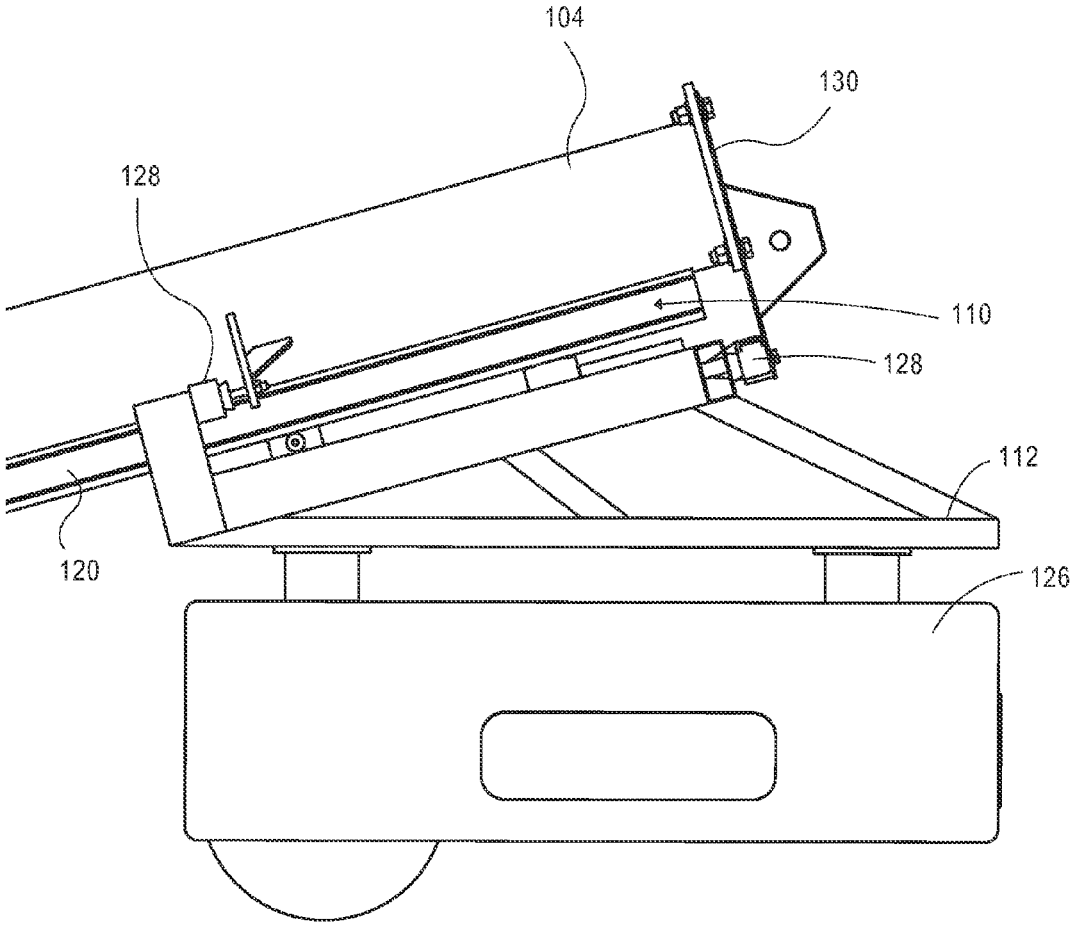
FIG. 4 is a partial diagrammatic side view of an end of one of the support arms with a carrier device and a payload being in the second (e.g., operative) position.
Figure 5:
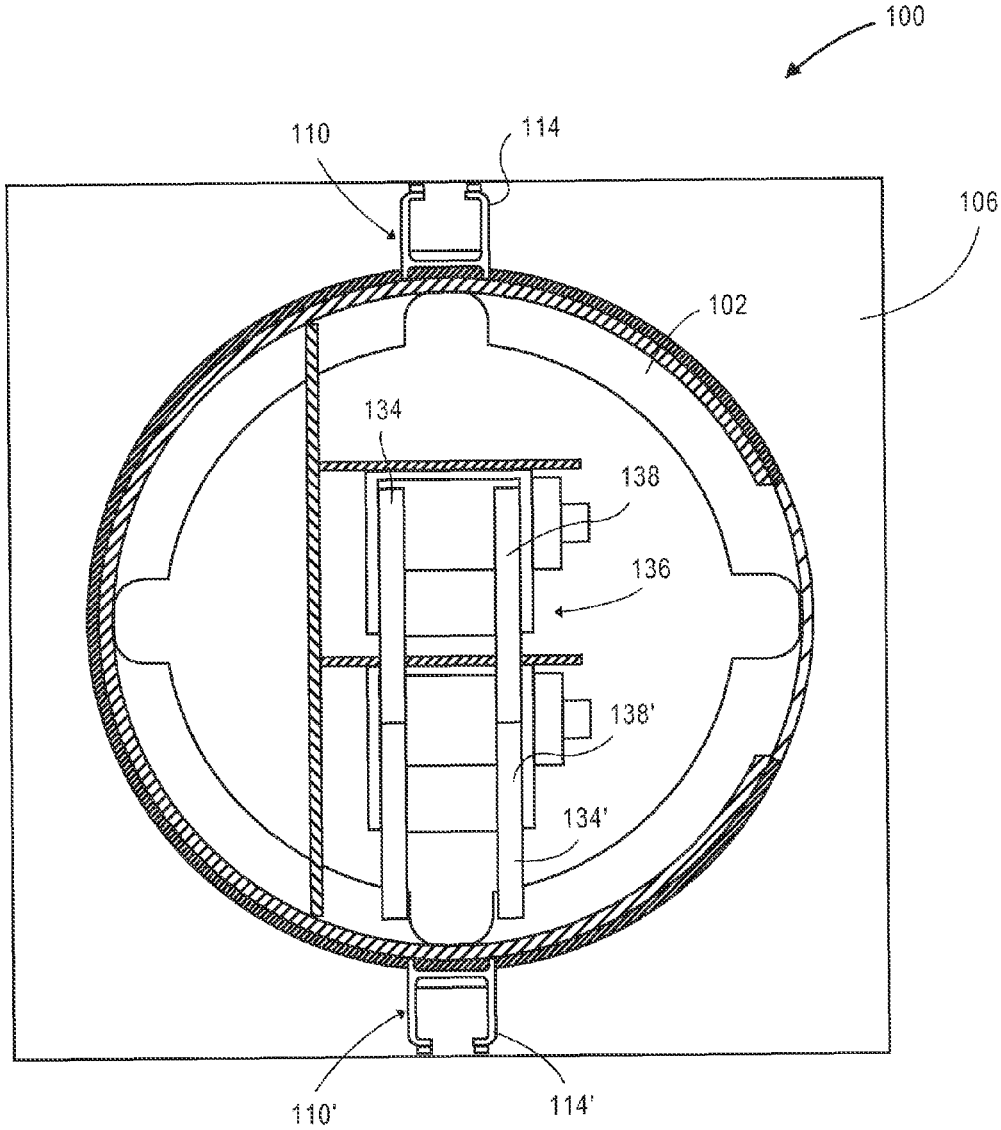
FIG. 5 is a diagrammatic sectional view of the support pole illustrating a displacement device comprising multiple winches.

The track assembly 110 (e.g., track portions 114, 118, 120) comprises a suitable track material that allows a carrier device 112 to carry a payload (e.g., a security camera, a luminaire, etc.) from a first position to a second position, and vice versa. For example, the track assembly 110 may comprise, but is not limited to: a metal track, a plastic track, and so forth. Moreover, in one or more implementations, the track assembly 110 may comprise channel-like tracks as shown in FIGS. 4 and 5.

As described above, the carrier device 112 may include a mounted payload 126 (shown in FIGS. 1 through 4), such as a security camera or a luminaire. However, it is contemplated that the mounted payload 126 may comprise other types of devices. For example, the payload 126 may be another type of lighting fixture, a sign, a traffic signal, or the like. The payload 126 may be mounted to the carrier device 112 via any suitable method, such as, but not limited to: fasteners, welding, and so forth. The carrier device 112 is movably mounted to the track assembly 110. For example, the carrier device 112 may include wheels or rollers that are positioned within the track assembly 110 to allow for movement within the track assembly 110. It is contemplated that the carrier device 112 may be a trolley or a cart in one or more implementations. As shown in FIG. 4, one or more stops 128 may be connected to the outer end 130 of the support arm 104 to limit the travel of the carrier device 112 and provide stability to the mounted payload 126. Moreover, as shown in FIGS. 2 and 3, the support arm track portion 120 extends from about the second end 124 of the transition track portion 118 to about the outer end 130 of the support arm 104.

While only a single carrier device 112 is shown in FIGS. 1 and 2, it is contemplated that the carrier device 112 may comprise one or more carrier devices 112 that are configured to traverse a signal track assembly 110. For example, in an implementation, a first carrier device 112 and a second carrier device 112 may be positioned along a single track assembly 110 and both are configured to traverse the track assembly 110 from a first position to a second position, and vice versa. In this example, the first and the second carrier devices 112 may be configured to carry a single payload 126 or multiple payloads 126 (e.g., the first carrier device 112 carries a first payload 126, and the second carrier device 112 carries a second payload 126, etc.).

In an implementation, as illustrated in FIG. 3, the carrier device 112 may be engaged to traverse the track assembly 110 via one or more cable(s) 132 attached to the carrier device 112. The cables 132 extend throughout at least a portion of the support pole 100 to allow the carrier device 112 to transition between a first position and a second position. For example, the carrier device 112 may transition from a first position (e.g., proximate to the lower end 106 of the support member 102) to a second position (e.g., proximate to the outer end 130 of the support arm 104). In this manner, the carrier device 112, along with the mounted payload 126, is vertically and horizontally displaced. The cables 132 may be comprised of any suitable material to provide transitional support to the carrier device 112. For example, the cables 132 may be a generally flexible steel cable, a generally flexible plastic cable (e.g., a plastic composite belt, a rubberized composite belt, etc.), or the like.

The cables 132, and the carrier device 112, may be operated with a displacement device 134. The displacement device 134 may be configured in a variety of ways. In one or more implementations, the displacement device 134 may comprise a pulley assembly 136 configured to transition (e.g., displace, traverse) the carrier device from a first position to a second position, where the second position comprises a position that is vertically and horizontally displaced from the first position. The pulley assembly 136 may include one or more winches 138 inside the support member 102 and proximate to the lower end 106 of the support member 102 as shown in FIG. 3. An operator may utilize the winch 138 (winch 138') via an access panel 139 shown in FIG. 1. In one or more implementations, the winch 138 may be engaged (e.g., operated) utilizing a crankshaft (not shown), such as a hand crank; a tool (not shown) configured to engage the winch 138, such as a drill; a motor, such as an electric motor or a gas-powered motor; and so forth. However, it is understood that the winch 138 may be engaged in other suitable processes as well.

As illustrated in FIG. 3, the pulley assembly 136 also includes a first pulley 140 positioned near the inner end 108 of the support arm 104. As shown, the cable(s) 132 extend upwardly from the winch 138 (cable 132' extends from winch 138') through the support member 102 to the pulley 140 (pulley 140'). The cable 132 then extends through the support arm 104 to a second pulley 142 positioned proximately to the outer end 130 of the support arm 104. The cable 132 is then connected to the carrier device 112 to transition the carrier device 112 from the first position to the second position when the displacement device 134 is engaged.

While not shown, it is contemplated that the displacement device 134 may comprise other configurations. For example, the displacement device 134 may comprise a motor (e.g., an electrical motor, or the like) configured to engage the winch 138, a crankshaft (as described above) configured to engage the winch 138, and so forth.

While not illustrated, a flexible power and/or data transmission cable may extend upwardly through the track assembly 110 from the lower end 106 of the support member 102 that is connected to the mounted payload 126. One or more spaced-apart sliders (e.g., slide strip, bearing slider, etc.) may be secured to the track assembly 110 to maintain the power and/or data transmission cable within the track assembly 110 while the carrier device 112 traverses (e.g., transitions) from the first position to the second position, and vice versa.

In one or more implementations, the support pole 100 described herein is configured to provide support to the mounted payload 126 when the carrier device 112 is positioned in the second position (e.g., vertically and horizontally displaced from the first position). For instance, the second position may comprise a position proximate to the outer end 130 of the support arm 104, and the first position may comprise a position proximate to the lower end 106 of the support member 102. Furthermore, when the support pole 100 is positioned (e.g., anchored) adjacent to a roadway or a walkway, the support arm 104 is configured to provide a line-of-sight to the roadway or the walkway. For example, the support arm 104 may extend at least partially over the roadway (or walkway) to provide illumination to the roadway from the payload 126 (in the case of the luminaire) or to provide surveillance capabilities from the payload 126 (in the case of security camera).

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A support pole comprising:

a support member comprising a pole, the pole having an upper end and a lower end;

a support arm having an outer end and an inner end, the inner end of the support arm connected to the support member proximate to the upper end;

a support member track portion connected to the support member;

a support arm track portion connected to the support arm and the support member track portion; and a displacement device configured to transition the carrier device from a first position to a second position, the second position is vertically and horizontally displaced from the first position, the displacement device including a winch configured to actuate the displacement device, the winch disposed internally within the pole, wherein the support member track portion and the support arm track portion are configured to transition a carrier device from the first position to the second position, wherein the support member track portion is disposed on an outside surface of the support member and the support arm track portion is disposed on an outside surface of the support arm.

2. The support pole as recited in claim 1, further comprising a transition member disposed between the support member and the support arm; and a transition track portion disposed between the support member track portion and the support arm track portion, the transition track portion including a first end and a second end.

3. The support pole as recited in claim 2, wherein the support member track portion extends at least substantially along the support member from about the lower end of the support member to the first end of the transition track portion.

4. The support pole as recited in claim 3, wherein the support arm track portion extends along the support arm from the outer end of the support arm to the second end of the transition track portion.

5. The support pole as recited in claim 2, wherein the transition member and the transition track portion are at least substantially curved.

6. The support pole as recited in claim 1, wherein the displacement device comprises a pulley assembly.

7. The support pole as recited in claim 6, wherein the pulley assembly comprises a first pulley proximate to the inner end of the support arm, a second pulley proximate to the outer end of the support arm, and a cable extending from the winch over the first and the second pulleys and connected to the carrier device.

8. A support pole comprising:

a support member comprising a pole, the pole having an upper end and a lower end, the lower end configured to be anchored proximate to a pathway;

a support arm having an outer end and an inner end, the inner end of the support arm connected to the support member proximate to the upper end;

a support member track portion connected to the support member;

a displacement device configured to transition the carrier device from a first position to a second position, the second position is vertically and horizontally displaced from the first position, the displacement device including a winch configured to actuate the displacement device, the winch disposed internally within the pole; and a support arm track portion connected to the support arm and the support member track portion, wherein the support member track portion and the support arm track portion are configured to transition a carrier device from the first position to the second position, the carrier device having a payload mounted thereon, wherein the support member track portion is disposed on an outside surface of the support member and the support arm track portion is disposed on an outside surface of the support arm.

9. The support pole as recited in claim 8, further comprising a transition member disposed between the support member and the support arm; and a transition track portion disposed between the support member track portion and the support arm track portion, the transition track portion including a first end and a second end.

10. The support pole as recited in claim 9, wherein the support member track portion extends at least substantially along the support member from about the lower end of the support member to the first end of the transition track portion.

11. The support pole as recited in claim 10, wherein the support arm track portion extends along the support arm from the outer end of the support arm to the second end of the transition track portion.

12. The support pole as recited in claim 9, wherein the transition member and the transition track portion are at least substantially curved.

13. The support pole as recited in claim 8, wherein the displacement device comprises a pulley assembly.

14. The support pole as recited in claim 13, wherein the pulley assembly comprises at least one winch proximate to the lower end of the support member, a first pulley proximate to the inner end of the support arm, a second pulley proximate to the outer end of the support arm, and a cable extending from the winch over the first and the second pulleys and connected to the carrier device.

15. The support pole as recited in claim 8, wherein the payload comprises a security camera.

16. A support pole configured to be anchored adjacent to a pathway comprising:

a support member comprising a pole, the pole having an upper end and a lower end, the lower end configured to be anchored adjacent to the pathway so that the support member extends at least substantially vertically with respect to the pathway when the lower end is anchored;

a support arm having an outer end and an inner end, the inner end of the support arm connected to the support member proximate to the upper end, the support arm having a line-of-sight to the pathway when the lower end is anchored;

a support member track portion connected to the support member;

a support arm track portion connected to the support arm and the support member track portion;

a displacement device configured to transition the carrier device from a first position to a second position, the second position is vertically and horizontally displaced from the first position, the displacement device including a winch configured to actuate the displacement device, the winch disposed internally within the pole, wherein the support member track portion and the support arm track portion are configured to transition a carrier device from the first position to the second position, the carrier device having a payload mounted thereon, wherein the support member track portion is disposed on an outside surface of the support member and the support arm track portion is disposed on an outside surface of the support arm.

17. The support pole as recited in claim 16, further comprising a displacement device configured to transition the carrier device from the first position to the second position, wherein the second position is vertically and horizontally displaced from the first position.

18. The support pole as recited in claim 16, wherein the payload comprises a security camera having a line-of-sight to the pathway and configured to provide surveillance capabilities when the lower end is anchored and the carrier device is in the second position.

* * * * *